United States Patent [19]

Siraco et al.

[11] Patent Number: 4,836,119

[45] Date of Patent: Jun. 6, 1989

[54] SPERICAL BALL POSITIONING APPARATUS FOR SEAMED LIMP MATERIAL ARTICLE ASSEMBLY SYSTEM

[75] Inventors: Frank J. Siraco, Malden; David S. Barrett, Needham, both of Mass.

[73] Assignee: The Charles Stark Draper Laboratory, Inc., Cambridge, Mass.

[21] Appl. No.: 171,263

[22] Filed: Mar. 21, 1988

[51] Int. Cl.[4] ..... D05B 21/00; D05B 27/14

[52] U.S. Cl. ..... 112/306; 112/121.11; 112/308; 271/251

[58] Field of Search ..... 271/251, 225, 236; 112/121.11, 308, 306, 322; 384/100

[56] References Cited

U.S. PATENT DOCUMENTS

| | | | |
|---|---|---|---|
| 3,550,933 | 12/1970 | Wilson | 271/251 |
| 3,908,986 | 9/1975 | Bleau | 271/236 |
| 4,076,335 | 2/1978 | Ahmed et al. | 384/100 X |
| 4,203,588 | 5/1980 | Joosten | 271/236 |
| 4,266,762 | 5/1981 | Kramer et al. | 271/225 |
| 4,312,281 | 1/1982 | Doyen et al. | 112/121 |
| 4,401,044 | 8/1983 | Bowditch | 112/262 |
| 4,411,418 | 10/1983 | Poehlein | 271/251 X |
| 4,432,541 | 2/1984 | Clark et al. | 271/251 |
| 4,457,243 | 7/1984 | Bowditch | 112/121 |
| 4,512,269 | 4/1985 | Bowditch | 112/121 |
| 4,632,046 | 12/1986 | Barrett et al. | 112/121 |
| 4,632,574 | 12/1986 | Wilson et al. | 384/100 |
| 4,669,718 | 6/1987 | Rovin | 112/121.12 X |
| 4,693,460 | 9/1987 | Adamson et al. | 112/306 X |
| 4,719,864 | 1/1988 | Barrett et al. | 112/121 |
| 4,730,824 | 3/1988 | Huau et al. | 271/251 X |

*Primary Examiner*—Andrew M. Falik

*Attorney, Agent, or Firm*—Lahive & Cockfield

[57] ABSTRACT

Method and apparatus for controlling the position of a sheet member (e.g., fabric) slidingly supported on a work surface, utilizing a drive train consisting of one or more drive wheels frictionally engaging a spherical ball captively supported within a housing. The drive wheels are preferrably located in spaced, mutually orthogonal relation proximate the great circle of the spherical ball. The spherical ball rests on and frictionally engages the fabric-to-be-positioned. Rotation of one of the drive wheels causes the spherical ball to rotate which, in turn, moves the fabric in a direction dependent on the location and orientation of said one drive wheel. The inventor can be implemented as an active feedback system utilizing the above-described apparatus together with position detectors and a controller.

32 Claims, 5 Drawing Sheets

SPERICAL BALL POSITIONING APPARATUS FOR SEAMED LIMP MATERIAL ARTICLE ASSEMBLY SYSTEM

REFERENCE TO RELATED APPLICATIONS

The subject matter of this application is related to that of U.S. Pat. No. 4,632,046, entitled "Assembly System for Seamed Articles", U.S. Pat. No. 4,401,044, entitled "System and Method for Manufacturing Seamed Articles", U.S. Pat. No. 4,457,243, entitled "Automated Seam Joining Apparatus", and U.S. Pat. No. 4,512,269, entitled "Automated Assembly System for Seamed Articles" and U.S. Pat. No. 4,719,864, entitled "Limp Material Seam Joining Apparatus with Rotatable Limp Material Feed Assembly".

BACKGROUND OF THE INVENTION

This invention relates to systems for automatic or computer-controlled manipulation of sheet material during processing, e.g., fabric or other limp material to be assembled at a sewing station.

During the construction of a useful item from raw stock of flat goods (e.g., cloth, paper, plastic, and film), it is often necessary to precisely position and guide the flat goods through a work station. Typical work stations perform assembly operations such as joining, cutting or folding. For example, such work stations can be equipped with sewing machines for joining multiple layers of limp fabric.

Conventionally, the positioning and guiding of the fabric-to-be-joined is accomplished by skilled human operators. The operators manually feed or advance the fabric-to-be-joined through the stitch forming mechanism of the sewing machine along predetermined seam trajectories on the fabric. The resultant seams can be straight or curved, or a combination of both as is often required in the assembly of fabric panels to form articles of clothing, for example. Typically, the fabric-to-be-joined must be precisely positioned and accurately directed to the sewing head to achieve the desired seam. The human operator must therefore function not only as a "manipulator" of the fabric but also as a real-time "sensing and feedback medium", making small adjustments, e.g., in orientation, fit-up and seam trajectory, to obtain quality finished goods. The adjustments are required, for example, due to variations in seam type, geometry, location and fit-up.

One drawback of this technique is that it is labor intensive; that is, a large portion of the cost for manufacture is attributable to manual labor. To reduce labor cost, automated or computer-controlled manufacturing techniques have been proposed in the prior art. In known arrangements for sewing a high precision seam, relative motion between the fabric-to-be-joined to the stitch forming mechanism is established (as in U.S. Pat. Nos. 4,457,243, 4,632,046 and 4,512,269, for example). The facility with which position control is achieved is a key factor in producing a quality seam of desired seam trajectory without involvement of human operators.

Accordingly, it is an object of the invention to provide an improved method and apparatus for positioning and guiding sheet material, e.g., fabric or other limp material to be processed.

It is another object of the present invention to provide an improved flat-material manipulation device suitable for automatic or computer-controlled manufacturing operations, which is of simple, rugged, versatile, and economical design.

Yet another object of the present invention is to provide an improved method and apparatus for precision feeding of fabric-to-be-joined at a sewing station.

SUMMARY OF THE INVENTION

These and other objects of the invention are accomplished by an improved apparatus for controlling the position of sheet material, e.g., fabric or other flat goods, slidingly supported on a work surface with a relatively low coefficient of friction. In accordance with the invention, the apparatus incorporates a spherical ball in frictional engagement with the sheet material and rotatable by at least one drive wheel so as to advance the sheet in a selected direction upon turning of the drive wheel. In specific practices of the invention, systems of one, two or three degrees of freedom are achieved by various alternative arrangements and orientations of drive wheels. For example, translation along a single axis is achieved using one drive wheel. As another, movement of sheet material with two translational degrees and one rotational degree of freedom is achieved using three spaced and mutually orthogonally oriented drive wheels.

More specifically, for an exemplary practice of the invention, the apparatus has a spherical ball of diameter "D" and at least one drive wheel of a diameter less than D. A stationary housing is adapted with an open-ended interior cavity to receive the ball and support the ball and drive wheel for rotation. For this, the housing also includes ball support and drive wheel support assemblies. The ball support assembly captively supports the ball in the cavity with a spherical segment of the ball extending from the open end. In this way, the ball is freely rotatable within the cavity while extending therefrom towards a work surface. The drive wheel support assembly positions each of the drive wheels so that its peripheral surface is in contact, or more specifically, in frictional engagement with the outer surface of the ball. The housing itself is supported so as to position the spherical segment adjacent to the work surface.

The coefficients of friction between the peripheral surface of the wheels and the outer surface of the ball and the coefficient of friction between the ball and the sheet material-to-be-controlled are all greater than the coefficient of friction between the sheet member and its supporting work surface.

In use, the positioning apparatus is disposed on a work surface with the spherical ball resiliently resting on a work piece. Turning of the drive wheel, e.g., by a motor drive arrangement, causes the ball to rotate. As the ball rotates, a work piece of sheet material located on the work surface is caused to move. The direction of such movement depends on the location, orientation and turning direction of the drive wheels.

Generally speaking, such a drive train formed by the drive wheels and spherical ball is simple, rugged, versatile and economical in design. The arrangement provides improved positioning and guiding of sheet material, and is adaptable for use with a variety of processing stations, including assembly systems for seamed articles as well as systems which transport sheet materials for other purposes. The invention embraces both the aforedescribed apparatus and the method of positioning and guiding the sheet material using such apparatus.

BRIEF DESCRIPTION OF THE DRAWINGS

For a fuller understanding of the features, advantages and objects of the invention, reference should be made to the following detailed description and the accompanying drawings, in which.

DESCRIPTION OF THE PREFERRED EMBODIMENT

Figure 1:
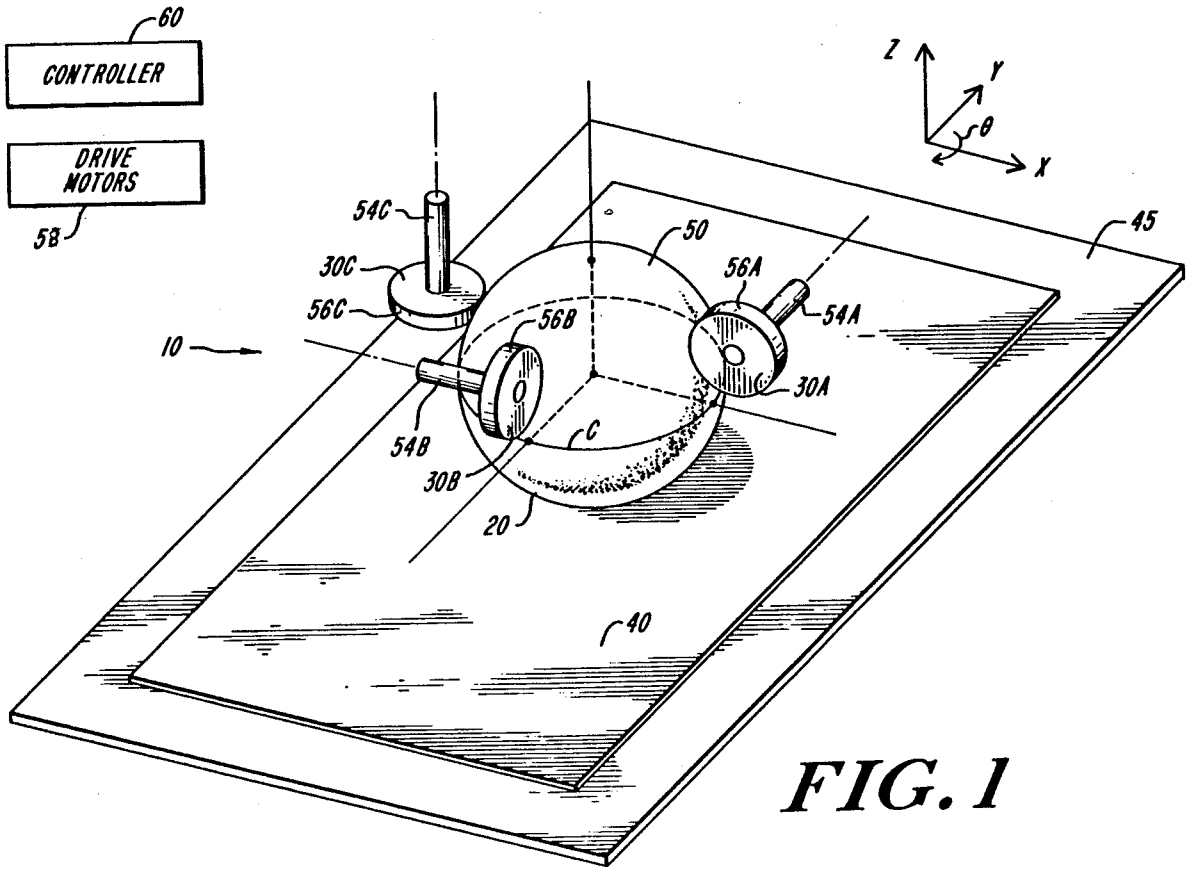
FIG. 1 is a perspective illustration useful in explaining the operation of a sheet material positioning apparatus in accordance with the invention.

Referring now to the drawings, FIG. 1 is a simplified illustration of an apparatus 10 for positioning and guiding sheet material 40 slidingly positioned on a work surface 45. The positioning apparatus 10 has a drive train formed by a spherical ball 20 rotatable by three drive wheels 30A, 30B, and 30C, though single and dual drive wheel configurations can also be implemented. Rotation of the spherical ball 20 effects movement of sheet material 40 (e.g., fabric, cloth, paper, plastic or film) in a selected direction along work surface 45. As shown, the sheet material 40 is slidingly supported horizontally on the work surface 45 with a relatively low coefficient of friction. By way of example, sheet material 40 may be a wool fabric and surface 45 may be a polished planar steel surface. The sheet material 40 represents work-in-process being transported by apparatus 10.

The spherical ball 20 has a diameter D and an outer surface 50 adapted for frictional engagement with the upper surface of sheet material 40. In the presently described embodiment, for example, ball 20 is similar in construction to the ball in the "mouse" input device manufactured by Apple Computer Inc. In the preferred embodiment, the ball 20 is supported by a support assembly (not shown in FIG. 1) so that its geometrical center is substantially stationary, i.e., free of translational movement. The spherical ball 20 rests on, and frictionally engages the sheet material 40 so that a driving connection is formed therebetween; that is, the coefficient of friction between the surface of ball 20 and the sheet material 40 is greater than the coefficient of friction between the material 40 and surface 45.

The illustrated drive wheels (30A, 30B, and 30C) are in spaced, mutually-orthogonally-oriented relation to one another. Each drive wheel is disk-like, with a driving axle (54A, 54B, 54C) extending from the center of the disk in an axial direction for coupling to an associated drive motor (not shown). The drive wheels each have an outer peripheral surface (56A, 56B, 56C) whereby the low coefficient of friction between the wheel and the outer surface at ball member 20 is at least higher than the coefficient of friction between the sheet member 40 and the work surface 45. By way of example, the wheels are constructed of teflon in the present embodiment.

The outer peripheral surfaces 56A, 56B and 56C are in frictional contact with the outer surface 50 of ball 20. With this configuration, when one of the drive wheels is rotated about its axis, it makes radial contact with the surface 50 of spherical ball 20, frictionally engages that surface, and causes the spherical ball 20 to rotate. The drive wheels are arranged so that each controls rotation of ball 20 about one axis of the XYZ coordinate system in FIG. 1.

The relative frictional characteristics of the drive wheels with respect to the spherical ball 20, permit each wheel to drive the ball 20 in the circumferential direction of the wheel while permitting substantially free motion of the ball with respect to the wheel in the axial direction. Thus, controlled, directional movement of the sheet material 40 via rotation of the spherical ball is induced in three orthogonal directions ($X,Y,\theta$) by rotation of selected drive wheels 30A, 30B, and 30C.

As illustrated in FIG. 1, the drive wheels 30A, 30B, and 30C are equi-angularly spaced at approximately 120° apart viewed from the top and located proximate to the horizontal great circle (designated "C") of the spherical ball 20. As shown, wheels 30A, 30B and 30C are positioned above the great circle C, but alternatively, the wheels could be below or on that great circle.

The diameters of the drive wheels 30 are preferrably substantially less than that of the spherical ball 20, e.g., one-third the size. The ratio of the diameters determines the sensitivity of the system, i.e., the extent of travel of the sheet material per unit of angular displacement of the drive wheels 30. Desired system sensitivity can be achieved by appropriate scaling of the diameters of the spherical ball 20 and drive wheels 30A, 30B, and 30C.

Each of the drive wheels 30A, 30B, and 30C are independently rotatable by an associated drive motor. As illustrated, rotation of the drive wheels 30 is effected and controlled by controller 60 which, for example, includes the drive motors and a motor control arrangement. The controller 60 controls rotation in a selected drive wheel 30 at a selected angular rate, resulting in a desired angular displacement. This, in turn, controls the direction and angular displacement of the spherical ball and ultimately the re-positioning or altered course of travel of the sheet material 40 on surface 45.

With the illustrated arrangement, rotation of drive wheel 30A in a clockwise direction causes the sheet material 40 to translate in the positive X direction, while counter-clockwise rotation causes it to translate in a negative X direction. In the same way, rotation of drive wheel 30B causes translation of the sheet material in the Y direction. (This is because the drive wheels 30A and 30B have respective axes parallel to the work surface 45, though orthogonal to one another.) Rotation of drive wheel 30C, on the other hand, causes rotation or angular displacement of the sheet material relative to the work surface 45 in the direction "$\theta$".

The three illustrated drive wheels 30 thus provide a driving arrangement which achieves three degrees of freedom, which in this case are in the X, Y and $\theta$ directions. With different arrangements, orientations and/or number of drive wheels, systems with differing degrees of freedom can be achieved.

A sheet material positioning apparatus in accordance with the invention can be incorporated into a variety of systems utilizing a sensed feedback system to precisely position sheet material in a closed loop configuration. Such systems are compatible for use in a wide range of applications.

Figure 2A:
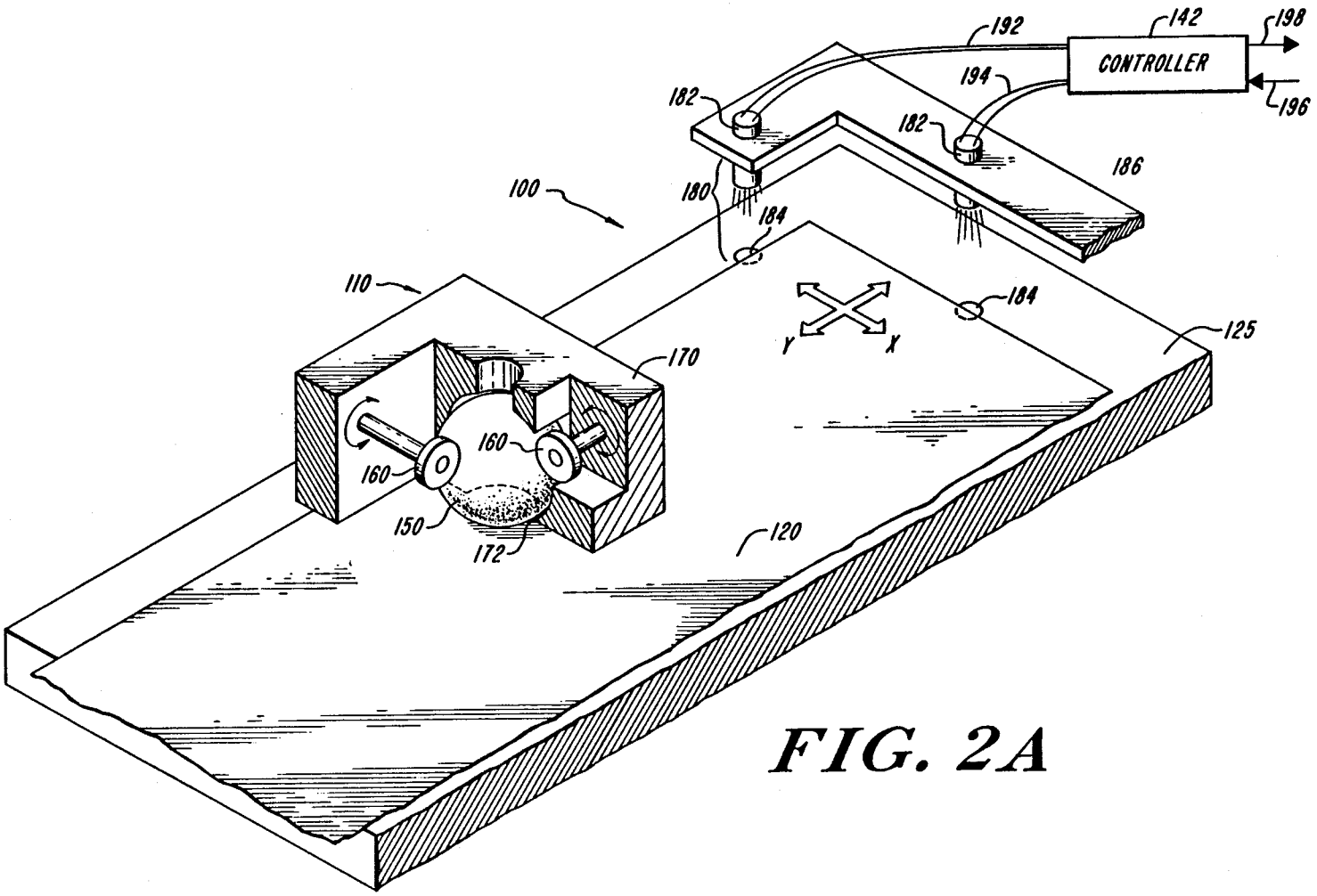
FIG. 2A is a perspective view of a sheet material positioning system in accordance with a practice of the invention.

For instance, FIG. 2A shows an exemplary configuration of an active positioning system 100 in accordance with the invention suitable for incorporation in a sewing station. The active system 100 includes a positioning apparatus 110 for positioning and guiding sheet material 120 with respect to a work surface 125, a position detection apparatus 130 for generating position signals representative of the position of the sheet material 120, and a controller 140 for controlling movement of the sheet material 120 by the positioning apparatus 110 in response to the position signal.

The positioning apparatus 110 has a housing 170 which encloses and supports a spherical ball 150 and a pair of drive wheels 160 arranged as described hereinabove with respect to the drive train of FIG. 1, except that only two degrees of freedom are achieved, namely, the X and Y directions. positioning apparatus 110 foregoes the angular positioning in the $\theta$ direction which was achieved in the earlier described embodiment.

Figure 2C:
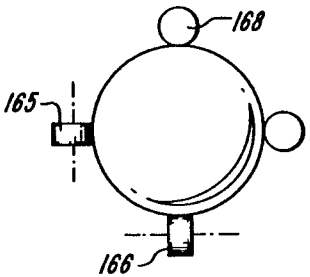
FIGS. 2B and 2C are alternative sectional views showing the layout of the drive train of FIG. 2A.
Figure 2B:
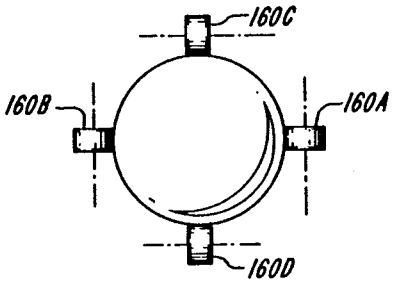

FIGS. 2B and 2C show two alternative configurations for the support and drive assembly for the ball 150 of the positioning apparatus of FIG. 2A. In FIG. 2B, the illustrated drive wheels 160 are arranged in mutually orthogonal pairs. The first pair has identically oriented, opposing, matched drive wheels 160A, 160B with parallel axes of rotation. The second pair has identically oriented, opposing, matched drive wheels 160C, 160D, also with parallel axes of rotation which are perpendicular to those of drive wheels 160A, 160B. The first pair effects translation of the sheet material 120 in the "X" direction through the synchronous rotation (in opposite spin directions) of drive wheel 160A, 160B; while the second pair effects translation in the "Y" direction through similar synchronous rotation of drive wheels 160C, 160D. Both drive wheels of pairs 160A, 160B or 160C, 160D may be rotated to effect rotation of the spherical ball 150, or only one drive wheel in each pair may be driven and the other merely follows, as such acting as a non-driving bearing and support element for the spherical ball 150.

Figure 3C:
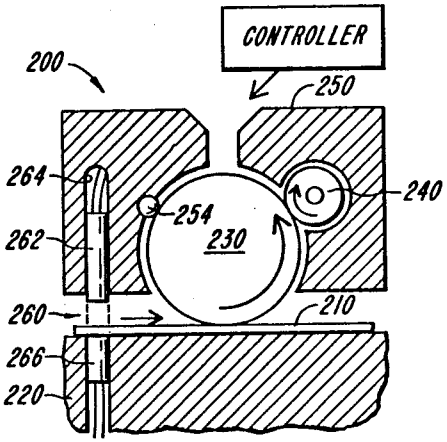
FIGS. 3A, 3B and 3C are side views partially in section of a sheet material positioning apparatus having a single degree of freedom, in accordance with another practice of the invention.
Figure 3B:
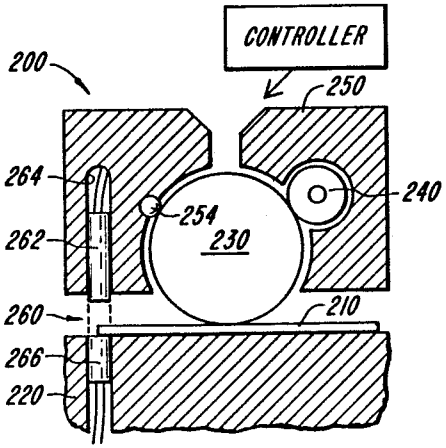
Figure 3A:
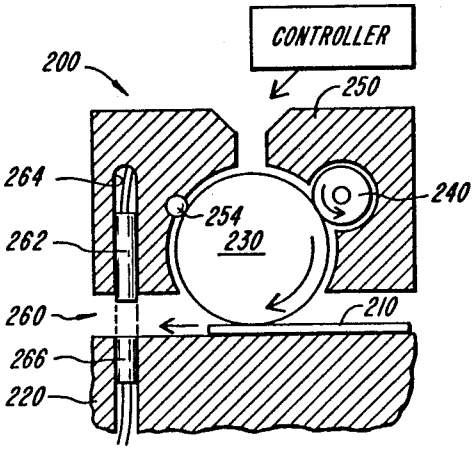
Figure 3F:
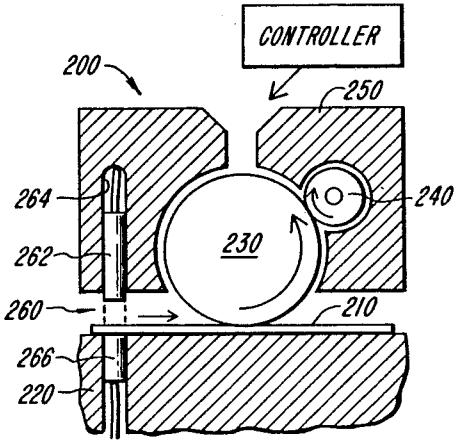
FIGS. 3D, 3E, and 3F are side views, partially in section, of a sheet material positioning apparatus similar to that of FIGS. 3A through 3C but incorporating a fluidic bearing.
Figure 3E:
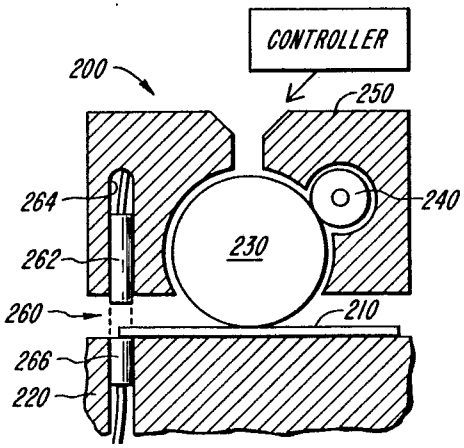
Figure 3D:
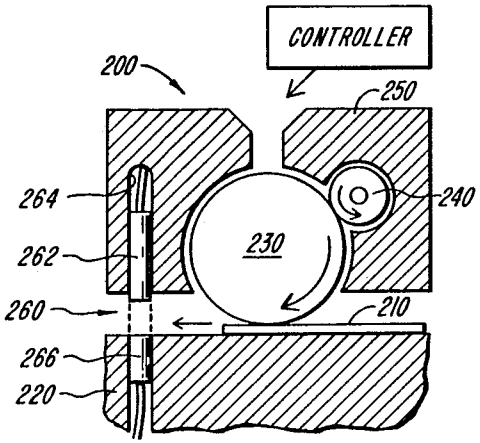

The structural symmetry of the illustrated arrangement of FIG. 2B is desirable for certain applications. Of course, other bearing arrangements can also be used as illustrated in FIG. 2C which shows single drive wheels (designated 165, 166) in each of the X and Y directions, and bearings 168 and 169 (replacing the other drive wheels of FIG. 2B). The illustrated bearings 168 and 169 represent any known mechanical arrangement for supporting the spherical ball 150 while permitting it to turn, such as a ball bearing or fluidic (including air-) bearing system. An embodiment of the invention utilizing roller (or wheel) bearings is shown in FIGS. 3A through 3C, and an embodiment utilizing fluidic bearings is shown in FIGS. 3D through 3F.

Positioning apparatus 110 further includes a housing 170 having an open ended interior cavity 172 adapted and sized to receive the spherical ball 150 with a clearance fit. The positioning apparatus 110 also has a ball support assembly which, as illustrated, comprises the drive wheels 160 and bearings 168 and 169 (FIG. 2C), and a wheel support assembly 172. The drive wheels 160 and bearings 168 and 169 (FIG. 2C) captively support the spherical ball 150 within the interior cavity 172 with a spherical segment of the spherical ball 150 extending from the open end of the cavity 172. More specifically, the portion of the spherical ball 150 extending from the cavity 172 can be referred to as a "spherical segment of one base", a term which imports a geometric form bounded by the spherical ball 150 and a plane intersecting the ball 150.

With this arrangement, the spherical ball 150 is captured between the sheet material 120, the driving wheels 160 and, where present, the bearings. As one skilled in the art will recognize, in many applications it is desirable that the containing forces be equiangularly applied to the spherical ball 150. For this, the drive wheels 160 and, where present, the bearings are angularly offset by approximately one hundred and twenty degrees from the tangent/contact point between the spherical ball 150 and the sheet material 120. To avoid accidental removal of the spherical ball 150 from the housing 170 when the positioning apparatus 110 is lifted, the opening to the interior cavity 172 can be sized less than the diameter of the spherical ball 150.

As mentioned above, for many applications it is desirable to incorporate the positioning apparatus into an active system in which it is responsive to and moves the sheet material in accordance with a sensed position feedback signal. FIG. 2A shows a position detection assembly 130 useful for generating such a feedback signal. The illustrated position detection assembly 130 has photodetectors 180 such as presence- or edge-sensing devices for monitoring the position of the sheet material 120. As illustrated, detectors 180 are electro-optical devices (although other types can be substituted, as can be appreciated by one skilled in the art). The detectors 180 include optically-coupled pairs of light sources 182 and associated light sensors 184. The illustrated light sources 182 are held by a bracket arm 186 above and in spaced relation to the work surface 125. Each of the light sensors 184 is embedded in the work surface 125 at a position in alignment with a respective one of the light sources 182 so as to detect the position of the sheet material 120 and generate position signals representative thereof. The position signals are fed to a controller 190 over buses 192, 194. Controller 190 also receives applied signals over bus 196 representative of a desired position of the sheet material 120 on the work surface 125. The controller 170 compares the sensed position signal (as a feed-back signal) with the applied signal to produce an error or deviation signal which is then used to control the operation of the positioning apparatus 110. The positioning apparatus 110 is directed by the controller 170 over bus 198 to move the sheet material 120 so as to reduce the deviation signal to an acceptable level. In effect, each of the drive wheels 160 is operationally linked to an associated one of the detectors 180 so as to respond to a sensed signal therefrom and move the sheet material 120 accordingly.

A further appreciation of the invention can be had with reference to FIGS. 3A through 3C which shows an alternative embodiment useful for linear positioning. Another alternate form is shown in FIGS 3D through 3F, using a fluidic bearing rather than the ball bearing of the embodiment of FIGS. 3A through 3C. The illustrated one-dimensional (i.e., one degree of freedom) positioning apparatus 200 employs single closed-loop control to properly position sheet material 210 on work surface 220.

The illustrated positioning apparatus 200 has a spherical ball 230 and a single drive wheel 40, both supported in housing 250. To support the ball for rotation, the housing 250 has, in addition to the drive wheel 240, a bearing 254 located opposite the drive wheel. Embedded in the housing 250 and work surface 220 is a detector 260, such as a thru-beam photo detector. The detector 260 has a light source or lamp 262 mounted in a concave recess 264 in the under-surface of the housing 250, and a light sensor 266 recessed into the work surface 220.

In operation of positioning apparatus 200, a closed loop control system is established between detector 260 and drive wheel 240. When the sensor 266 is fully uncovered, as shown in FIG. 3A, the full transmission of light generates a signal so indicating. Controller 280, on receipt of such signal, causes drive wheel 240 to rotate counter-clockwise, rotating spherical ball 230 clockwise, and thereby translating the sheet material 210 to the left, i.e., towards the location of the detector 260. When the sensor 266 is half covered by the sheet material 210 as shown in FIG. 3B, the drive wheel 240 stops rotating. If the sheet material 210 fully covers the sensor 266, as illustrated in FIG. 3C, the signal received by controller 280 causes the drive wheel 240 to rotate clockwise, rotating spherical ball 230 counter-clockwise and translating the sheet material to the right until the detector 260 is half covered. In this way, the active positioning system attempts to continuously align an edge of the sheet material 210 with a spot (i.e., the detector location) on the work surface 220. For very high speed or in more complicated operations, a more sophisticated control system can be implemented.

Figure 4:
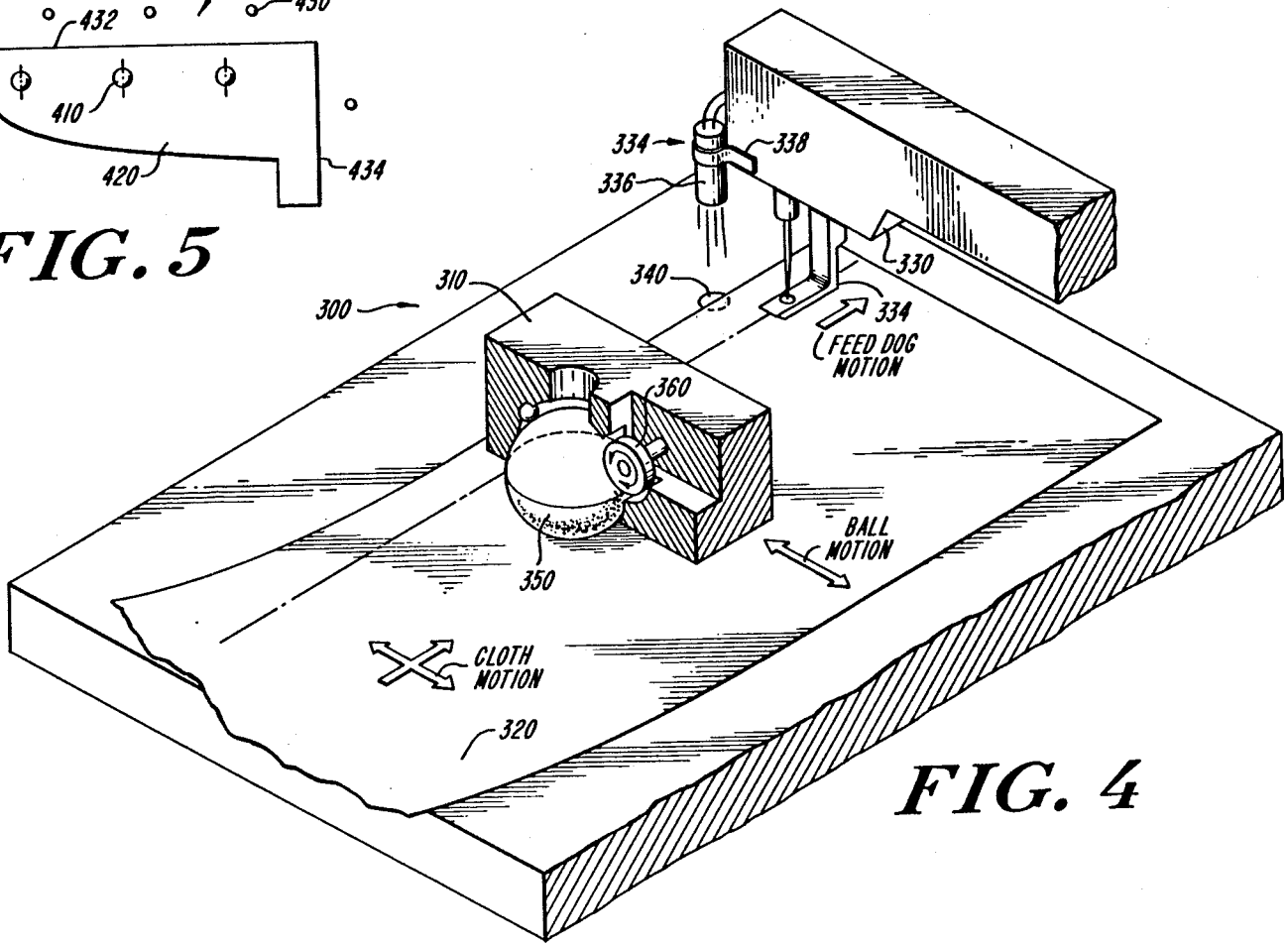
FIG. 4 is a perspective view of a typical sewing station equipped with the sheet material positioning apparatus shown in FIGS. 3A through 3C.

Positioning apparatus 200 is of a versatile design susceptible of a wide variety of applications. Of course, positioning apparatus 200 can be modified by one skilled in the art to meet the special needs of any particular application. For example, FIG. 4 shows a sewing station 300 incorporating a one-dimensional positioning system 310 similar to system 200 of FIGS. 3A–3C for guiding and positioning sheet material 320 being fed into a stitch-forming head or sewing machine 330.

As illustrated, the stitch-forming head 330 includes a sewing needle 332, presser foot 333, and feed dogs (not shown) beneath sheet material 320. A detector 334 has a light source 336 attached by a bracket 338 to the stitch-forming head 330, and a light-receiving sensor 340 vertically aligned with the source 336 for optical communication therewith whenever the light path therebetween is not obstructed by the sheet material 320.

In use, the positioning system 310 aligns the edge of the sheet material in the X direction with respect to the edge detectors 334 as the sheet material is being pulled through the stitch-forming head 330 in the Y direction by the feed dogs or other known expediencies. In this case, the spherical ball 350 is free to rotate in response to movement of the sheet material 320 in the direction it is being pulled by the feed dogs, designated Y, and is driven perpendicularly to that direction by the drive wheel 360 to permit stitching along a desired stitch trajectory. It should be noted that the sensed edge of the sheet material 320 is curved, as can be the resulting stitch trajectory. Of course, other processing heads can be substituted for the stitch forming head 330 to perform a wide range of sewing, pressing, cutting and/or folding operations, for example.

Figure 5:
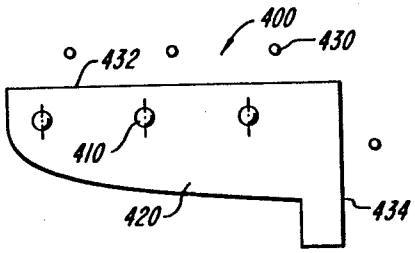
FIG. 5 is a schematic representation of a processing station equipped with a plurality of multi-dimensional positioning apparatus in accordance with yet another practice of the invention.

For increased versatility, two or more multi-dimensional positioning apparatus can be used to translate, rotate or otherwise guide sheet material in a controlled fashion into a work station. For example, FIG. 5 depicts a system 400 having three multi-dimensional positioning assemblies 410, 412 and 414 (each similar to that of FIG. 2A) for positioning sheet material 420 as directed by four detectors 430A–430D arranged to sense first and second edges 432, 434 of the sheet material 420. Such a system can be used in assembly or other processes which now require operators to load and advance sheet material into and through a work station. The sensor positions establish reference points or lines (straight or curved) against which the actual position of the sheet material is compared, with the positioning apparatus 410 used to correct any discrepancies between the actual position and the reference points or lines.

The invention can be embodied in other specific forms without departing from the spirit or essential characteristics thereof. The described embodiments of the invention are to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. Apparatus for controlling the position of a sheet member slidingly supported on a work surface with a relatively low coefficient of friction, comprising:

A. a spherical ball member having a diameter D,

B. at least one drive wheel, each of said drive wheels having a diameter less than D, C. a housing including an open-ended interior cavity adapted to receive said ball member, and further including:

a ball support assembly including means for captively supporting said ball member in said cavity with a spherical segment of said ball member extending from said open end and whereby said ball member is rotatable within said cavity, and a drive wheel support assembly including means for positioning each of said wheels so that its peripheral surface is in contact with said outer surface of said ball member, whereby the coefficient of friction between said peripheral surface of said wheel and said outer surface of said ball member is greater than the coefficient of friction between said sheet member and said work surface, D. a housing support including means for supporting said housing whereby said ball member, said drive wheels, and said housing are on the same side of said work surface, and said spherical segment is positioned opposite and adjacent to said work surface with the coefficient of friction between the outer surface of said ball member and said sheet member being greater than the coefficient of friction between said sheet member and said work surface.

2. Apparatus according to claim 1 including one drive wheel, said one drive wheel having its axis of rotation substantially parallel to the portion of said work surface adjacent to said spherical segment of said ball member.

3. Apparatus according to claim 2, further comprising:

a wheel drive assembly including means operative to selectively drive said drive wheels about their respective axes of rotation in response to applied control signals.

4. Apparatus according to claim 3, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

5. Apparatus according to claim 1 including a first drive wheel and a second drive wheel, each of said first and second drive wheels having its axis of rotation substantially parallel to the portion of said work surface adjacent to said spherical segment of said ball member, and wherein said drive wheel support assembly includes means for supporting said first and second drive wheels with their respective axes of rotation orthogonal to one another.

6. Apparatus according to claim 5, further comprising:

a wheel drive assembly including means operative to selectively drive said drive wheels about their respective axes of rotation in response to applied control signals.

7. Apparatus according to claim 6, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

8. Apparatus according to claim 1 wherein said ball support assembly includes at least one of said drive wheels.

9. Apparatus according to claim 8, further comprising:

a wheel drive assembly including means operative to selectively drive said drive wheels about their respective axes of rotation in response to applied control signals.

10. Apparatus according to claim 9, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

11. Apparatus according to claim 1 including one drive wheel having its axis of rotation angularly offset with respect to said work surface.

12. Apparatus according to claim 11, further comprising:

a wheel drive assembly including means operative to selectively drive said drive wheels about their respective axes of rotation in response to applied control signals.

13. Apparatus according to claim 12, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

14. Apparatus according to claim 1 wherein said ball support assembly includes at least one ball having a diameter less than D and positioned between the outer surface of said ball member and the interior surface of said cavity of said housing.

15. Apparatus according to claim 14, further comprising:

a wheel drive assembly including means operative to selectively drive said drive wheels about their respective axes of rotation in response to applied control signals.

16. Apparatus according to claim 15, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

17. Apparatus according to claim 1 wherein said ball support assembly includes a fluidic bearing between the outer surface of said ball member and the interior surface of said housing of said cavity.

18. Apparatus according to claim 17, further comprising:

a wheel drive assembly including means operative to selectively drive said drive wheels about their respective axes of rotation in response to applied control signals.

19. Apparatus according to claim 8, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

20. Apparatus according to claim 1, further comprising:

a wheel drive assembly including means operative to selectively drive said drive wheels about their respective axes of rotation in response to applied control signals.

21. Apparatus according to claim 20, further comprising:

a position detector including means for generating position signals representative of the position of said sheet member on said work surface, and a controller including means for generating said control signals from said position signals and applied signals representative of a desired position of said sheet member on said work surface whereby said wheels drive said ball member to move said sheet member toward said desired position.

22. A sewing machine system for positioning and joining a multiple layer limp material workpiece, comprising:

A. a seam joiner including a workpiece support surface for slidingly supporting said workpiece in a workpiece plane extending parallel to first (X) and second (Y) mutually perpendicular reference axes with a relatively low coefficient of friction, and including a reciprocating needle extending along a needle axis angularly offset from said workpiece plane, and an associated bobbin assembly and controller therefore including seam joining assembly for selectively joining overlying regions of said workpiece at said needle axis, B. first workpiece positioning means for selectively controlling the portion of said workpiece in the direction of said first axis, C. second workpiece positioning means for selectively controlling the position of said workpiece in the direction of said second axis, D. edge sensing means for generating a position signal representative of the relative position of a predetermined edge of said workpiece with respect to said needle in the direction of said first axis, E. a controller including:

(1) means selectively operative for controlling said second workpiece positioning means to drive said workpiece past said needle in the direction of said second axis, (2) means responsive to said position signal for controlling said first workpiece positioning means to position said workpiece with said predetermined edge to be substantially at a predetermined distance in the direction of said first axis from said needle, wherein said first workpiece positioning means comprises:

A. a spherical ball member having a diameter D,

B. at least one drive wheel, each of said drive wheels having a diameter less than D, C. a housing including an open-ended interior cavity adapted to receive said ball member, and further including:

a ball support assembly including means for captively supporting said ball member in said cavity with a spherical segment of said ball member extending from said open end and whereby said ball member is rotatable within said cavity, and a drive wheel support assembly including means for positioning each of said wheels so that its peripheral surface is in contact with said outer surface of said ball member, whereby the coefficient of friction between said peripheral surface of said wheel and said outer surface of said ball member is greater than the coefficient of friction between said sheet member and said work surface, D. a housing support including means for supporting said housing whereby said ball member, said drive wheels, and said housing are on the same side of said work surface and said spherical segment is positioned opposite and adjacent to said work surface with the coefficient of friction between the outer surface of said ball member and said sheet member being greater than the coefficient of friction between said sheet member and said work surface.

23. A sewing machine system according to claim 22 including one drive wheel, said one drive wheel having its axis of rotation substantially parallel to the portion of said work surface adjacent to said spherical segment of said ball member.

24. A sewing machine system according to claim 22 including a first drive wheel and a second drive wheel, each of said first and second drive wheels having its axis of rotation substantially parallel to the portion of said work surface adjacent to said spherical segment of said ball member, and wherein said drive wheel support assembly includes means for supporting said first and second drive wheels with their respective axes of rotation orthogonal to one another.

25. A sewing machine system according to claim 22 wherein said ball support assembly includes at least one of said drive wheels.

26. A sewing machine system according to claim 22 wherein said ball support assembly includes at least one ball having a diameter less than D and positioned between the outer surface of said ball member and the interior surface of said cavity of said housing.

27. A sewing machine system according to claim 22 wherein said ball support assembly includes a fluidic bearing between the outer surface of said ball member and the interior surface of said housing of said cavity.

28. A sewing machine system according to claim 22 further comprising:

third workpiece positioning means for selectively controlling the angular position of said workpiece about a third reference axis mutually perpendicular to said first and second axis, and wherein said controller includes:

means selectively operative to control said third workpiece positioning means to position said workpiece to be substantially at a predetermined angular orientation with respect to said first and second axis.

29. Apparatus for controlling the position of a member slidingly supported on a work surface with a relatively low coefficient of friction, comprising:

A. a plurality of positioning assemblies, each of said positioning assemblies including:

i. a spherical ball member having a diameter D, ii. at least one drive wheel, each of said drive wheels having a diameter less than D, iii. a housing including an open-ended interior cavity adapted to receive said ball member, and further including:

a ball support assembly including means for captively supporting said ball member in said cavity with a spherical segment of said ball member extending from said open end and whereby said ball member is rotatable within said cavity, and a drive wheel support assembly including means for positioning each of said wheels so that its peripheral surface is in contact with said outer surface of said ball member, whereby the coefficient of friction between said peripheral surface of said wheel and said outer surface of said ball member is greater than the coefficient of friction between said sheet member and said work surface, iv. a housing support including means for supporting said housing whereby said ball member, said drive wheels, and said housing are on the same side of said work surface, and said spherical segment is resiliently positioned opposite and adjacent to said work surface, with the coefficient of friction between the outer surface of said ball member and said sheet member is greater than the coefficient of friction between said sheet member and said work surface.

B. a position detector including means for generating position signals representative of the position of said sheet member on said work surface, and C. a controller including means for generating said control signals from said position signals and applied signals representative of a desired position of said sheet member on said work surface whereby said wheels drive said ball member to move said sheet member toward said desired position

30. Apparatus according to claim 29 wherein each of said positioning assemblies includes one drive wheel, said one drive wheel having its axis of rotation substantially parallel to the portion of said work surface adjacent to said spherical segment of said ball member.

31. Apparatus according to claim 29 wherein each of said positioning assemblies includes a first drive wheel and a second drive wheel, each of said first and second drive wheels having its axis of rotation substantially parallel to the portion of said work surface adjacent to said spherical segment of said ball member, and wherein said drive wheel support assembly includes means for supporting said first and second drive wheels whereby their respective axes of rotation are orthogonal.

32. Apparatus according to claim 29 wherein each of said positioning assemblies includes one drive wheel having its axis of rotation angularly offset with respect to said work surface.

* * * * *